US008571428B2

(12) United States Patent
Kim

(10) Patent No.: US 8,571,428 B2
(45) Date of Patent: Oct. 29, 2013

(54) IMAGE FORMING APPARATUS AND TRANSFER DEVICE THEREOF

(75) Inventor: Jung Woo Kim, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 331 days.

(21) Appl. No.: 12/968,358

(22) Filed: Dec. 15, 2010

(65) Prior Publication Data

US 2011/0150542 A1 Jun. 23, 2011

(30) Foreign Application Priority Data

Dec. 22, 2009 (KR) ..... 10-2009-0129107

(51) Int. Cl.
*G03G 15/00* (2006.01)

(52) U.S. Cl.
USPC ..... 399/49; 399/121; 399/297

(58) Field of Classification Search
USPC ..... 399/49, 121, 297
See application file for complete search history.

(56) References Cited

U.S. PATENT DOCUMENTS 6,301,023 B1 * 10/2001 Hirai et al. ..... 358/498
2009/0252517 A1 * 10/2009 Tachiki et al. ..... 399/66

* cited by examiner

*Primary Examiner* — Walter L Lindsay, Jr.
*Assistant Examiner* — Roy Y Yi
(74) *Attorney, Agent, or Firm* — Stanzione & Kim, LLP

(57) ABSTRACT

An image forming apparatus having an improvement to increase the reliability of a sensing operation that is carried out to improve image quality, and a transfer device thereof. The image forming apparatus includes at least one photosensitive member, a plurality of developing units to supply developer to the at least one photosensitive member so as to form a visible image, and a transfer belt to transfer the visible image formed on the at least one photosensitive member to a printing medium, an inner surface of the transfer belt being rotatably supported by at least two rollers. The image forming apparatus further includes at least one sensor to sense a mark formed on the transfer belt, and a supporting unit to support the transfer belt at a position corresponding to the at least one sensor so as to apply a tensile force to the transfer belt. The supporting unit includes a first supporting portion and a second supporting portion arranged to support the transfer belt at different two positions in a rotating direction of the transfer belt.

18 Claims, 10 Drawing Sheets

IMAGE FORMING APPARATUS AND TRANSFER DEVICE THEREOF

CROSS-REFERENCE TO RELATED APPLICATIONS

This application claims priority under 35 U.S.C. §119(a) of Korean Patent Application No. 2009-0129107, filed on Dec. 22, 2009 in the Korean Intellectual Property Office, the disclosure of which is incorporated herein by reference.

BACKGROUND

1. Field of the Invention

Exemplary embodiments of the present general inventive concept relate to an image forming apparatus having a transfer device to transfer an image to a printing medium.

2. Description of the Related Art

Image forming apparatuses are devised to form an image on a printing medium. Examples of image forming apparatuses include printers, copiers, fax machines, and devices combining functions thereof.

In an electro-photographic image forming apparatus as a kind of image forming apparatuses, light is irradiated to a photosensitive member charged with a predetermined electric potential, to form an electrostatic latent image on a surface of the photosensitive member, and a developer is fed to the electrostatic latent image, forming a visible image. The visible image, formed on the photosensitive member, is transferred to a printing medium via a transfer device. After the image transferred to the printing medium undergoes a fusing operation, the printing medium is discharged out of the image forming apparatus.

In the case of a color image forming apparatus, a transfer device generally includes a transfer belt. The color image forming apparatus may realize an image of a desired color by overlapping a plurality of colors of developers on a transfer belt, or may realize an image of a desired color by directly overlapping images on a printing medium fed by the transfer belt.

To allow the color image forming apparatus to print a high quality color image, it may be necessary to appropriately adjust an image density and to accurately align images to be overlapped by the transfer device. To this end, the color image forming apparatus may function to sense a predetermined mark in a sensing region on the transfer belt, appropriately controlling a printing operation according to the sensed result.

SUMMARY

It is a feature and utility of the present general inventive concept to provide an image forming apparatus having an improvement to increase the reliability of a sensing operation that is carried out to improve image quality, and a transfer device thereof.

Additional features and utilities of the present general inventive concept will be set forth in part in the description which follows and, in part, will be obvious from the description, or may be learned by practice of the present general inventive concept.

Embodiments of the present general inventive concept include an image forming apparatus that may include at least one photosensitive member, a plurality of developing units to supply developer to the at least one photosensitive member so as to form a visible image, a transfer belt to transfer the visible image formed on the at least one photosensitive member to a printing medium, an inner surface of the transfer belt being rotatably supported by at least two rollers, at least one sensor to sense a mark formed on the transfer belt, and a supporting unit to support the transfer belt at a position corresponding to the at least one sensor so as to apply a tensile force to the transfer belt, wherein the supporting unit may include a first supporting portion and a second supporting portion arranged to support the transfer belt at two different positions in a rotating direction of the transfer belt.

The at least one sensor may be arranged to sense the mark of the transfer belt between the first supporting portion and the second supporting portion.

The supporting unit may include a supporting surface facing the inner surface of the transfer belt and extending in the rotating direction of the transfer belt, and the supporting surface may include at least one raised portion protruding farther toward the transfer belt than the remaining portion of the supporting surface.

A part of the supporting surface may be arranged so as not to come into contact with the transfer belt.

The transfer belt may obliquely extend with respect to the supporting surface between the first supporting portion and the second supporting portion of the supporting unit.

An inclination angle of the transfer belt with respect to the supporting surface of the supporting unit may be about 30 degrees or less.

The supporting surface may include a first guide surface upstream of the first supporting portion in the rotating direction of the transfer belt and a second guide surface downstream of the second supporting portion in the rotating direction of the transfer belt.

The at least two rollers may include a driving roller to provide the transfer belt with drive force, and the supporting unit may be arranged close to the driving roller at a position downstream of the driving roller in the rotating direction of the transfer belt.

The at least one sensor may be inclined with respect to the transfer belt between the first supporting portion and the second supporting portion, and an inclination angle of the at least one sensor with respect to the transfer belt may be about 10 degrees or less.

Embodiments of the present general inventive concept further include an image forming apparatus that may include a plurality of developing units, each of the plurality of developing units may include a photosensitive member respectively and may be configured to supply developer to the corresponding photosensitive member so as to form visible images, a transfer belt may be to come into contact with the plurality of photosensitive members to allow the visible images formed on the plurality of photosensitive members to be transferred to and overlap one another on the transfer belt, an inner surface of the transfer belt being rotatably supported by at least two rollers, at least one sensor to sense a mark formed on the transfer belt, and a supporting unit to support the transfer belt at a position corresponding to the at least one sensor so as to apply a tensile force to the transfer belt, wherein the supporting unit may include a first supporting portion arranged to press and support the inner surface of the transfer belt, and a second supporting portion spaced apart from the first supporting portion in a rotating direction of the transfer belt and protruding farther toward the transfer belt than the first supporting portion to press and support the inner surface of the transfer belt.

The first supporting portion may be arranged between the driving roller and the second supporting portion in the rotating direction of the transfer belt.

Embodiments of the present general inventive concept further include a transfer device to be mounted in an image forming apparatus including at least one sensor, the transfer device may include at least two rollers, a transfer belt including a sensing region to be sensed by the at least one sensor and rotatably supported by the at least two rollers, and a supporting plate arranged to support an inner surface of the transfer belt so as to apply a tensile force to the transfer belt, wherein the supporting plate includes a first supporting portion arranged to come into contact with the transfer belt at a position upstream of the sensing region in a rotating direction of the transfer belt, a second supporting portion arranged to come into contact with the transfer belt at a position downstream of the sensing region in the rotating direction of the transfer belt, and a non-contact portion spaced apart from the inner surface of the transfer belt between the first supporting portion and the second supporting portion.

The supporting plate may be arranged close to one of the at least two rollers.

The supporting plate may be arranged downstream of one of the at least two rollers in the rotating direction of the transfer belt, and the second supporting portion may protrude farther toward the transfer belt than the first supporting portion.

The supporting plate may further include a supporting surface facing the inner surface of the transfer belt and extending in the rotating direction of the transfer belt, and the supporting surface may include a stepped portion.

BRIEF DESCRIPTION OF THE DRAWINGS

These and/or other features and utilities of the present general inventive concept will become apparent and more readily appreciated from the following description of the exemplary embodiments of the present general inventive concept, taken in conjunction with the accompanying drawings of which.

DETAILED DESCRIPTION OF THE EMBODIMENTS

Figure 1:
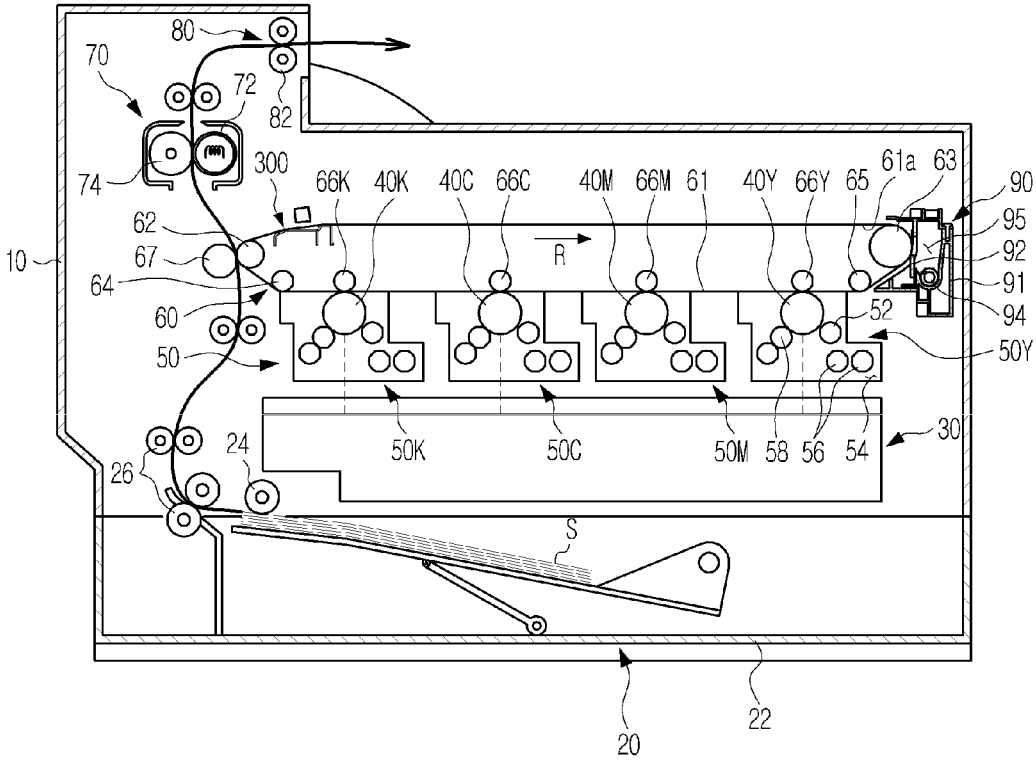
FIG. 1 is a view illustrating a configuration of an image forming apparatus according to an exemplary embodiment of the present general inventive concept.

Reference will now be made in detail to the exemplary embodiments of the present general inventive concept, examples of which are illustrated in the accompanying drawings, wherein like reference numerals refer to like elements throughout. FIG. 1 is a view illustrating a configuration of an image forming apparatus according to an exemplary embodiment of the present general inventive concept.

As illustrated in FIG. 1, the image forming apparatus 1 may include a body 10, a printing medium supply device 20, a light scanning device 30, a plurality of photosensitive members 40Y, 40M, 40C, and 40K, a developing device 50, a transfer device 60, a fusing device 70, and a printing medium discharge device 80.

The body 10 defines an exterior appearance of the image forming apparatus 1 and supports a variety of constituent elements installed therein.

The printing medium supply device 20 may include a cassette 22 in which printing media S may be stored, a pickup roller 24 to pick up the printing media S stored in the cassette 22 sheet by sheet, and feed rollers 26 to feed the picked-up printing medium S toward the transfer device 60.

The light scanning device 30 may irradiate light, corresponding to image information, to the photosensitive members 40Y, 40M, 40C, and 40K, thereby forming electrostatic latent images on surfaces of the respective photosensitive members 40Y, 40M, 40C, and 40K. In the following description, when it may be necessary to classify the photosensitive members, the photosensitive member 40C is referred to as a first photosensitive member, the photosensitive member 40M is referred to as a second photosensitive member, the photosensitive member 40Y is referred to as a third photosensitive member, and the photosensitive member 40K is referred to as a fourth photosensitive member.

The developing device 50 may supply developer to the electrostatic latent images formed on the photosensitive members 40Y, 40M, 40C, and 40K, thereby forming visible images. The developing device 50 may include four developing units 50Y, 50M, 50C, and 50K in which different colors of developers, for example, yellow developer Y, magenta developer M, cyan developer C, and black developer K are received respectively.

Each of the developing units 50Y, 50M, 50C, or 50K may include a charger 52, a developer storage 54, a developer feed member 56, and a developing member 58. The charger 52 may electrically charge the surface of the corresponding photosensitive member 40Y, 40M, 40C, or 40K, prior to forming the electrostatic latent images on the photosensitive members 40Y, 40M, 40C, and 40K. The developer stored in the developer storage 54 may be fed to the developing member 58 by the developer feed member 56. The developing member 58 may supply the developer to the electrostatic latent image formed on the corresponding photosensitive member 40Y, 40M, 40C, or 40K, to enable formation of a visible image.

Although FIG. 1 illustrates an exemplary configuration in which the four photosensitive members 40Y, 40M, 40C, and 40K are included in the respective developing units 50Y, 50M, 50C, and 50K, alternatively, four developing units may be configured to form a visible image on a single photosensitive member.

The transfer device 60 may serve to transfer the visible images formed on the respective photosensitive members 40Y, 40M, 40C, and 40K to the printing medium S. The transfer device 60 may include a transfer belt 61, a driving roller 62, a supporting roller 63, tension rollers 64 and 65, and transfer rollers 66Y, 66M, 66C, and 66K.

The transfer device 60 has a width 60W and a length 60L.

The transfer belt 61 may be rotatably supported by the driving roller 62 and supporting roller 63. The driving roller 62 may be rotated upon receiving power from a drive source (not illustrated) mounted in the body 10. The driving roller 62 comes into contact with an inner surface 61*a* of the transfer belt 61 to transmit drive force to the transfer belt 61, allowing the transfer belt 61 to be rotated in a direction designated by the arrow R. The supporting roller 63 may be arranged at an opposite side of the driving roller 62 to support the inner surface 61*a* of the transfer belt 61.

An outer surface of the transfer belt 61 faces the respective photosensitive members 40Y, 40M, 40C, and 40K. The transfer rollers 66Y, 66M, 66C, and 66K are arranged to correspond to the respective photosensitive members 40Y, 40M, 40C, and 40K and support the inner surface 61*a* of the transfer belt 61.

During a color printing operation of the image forming apparatus 1, the transfer rollers 66Y, 66M, 66C, and 66K are pressed toward the respective photosensitive members 40Y, 40M, 40C, and 40K, causing the respective visible images formed on the photosensitive members 40Y, 40M, 40C, and 40K to be sequentially transferred to the transfer belt 61 and overlap one another. The resulting image on the transfer belt 61 is transferred to the printing medium S supplied from the printing medium supply device 20 while the printing medium S passes between the transfer belt 61 and a transfer roller 67.

On the other hand, during a black-and-white printing operation of the image forming apparatus 1, the transfer roller 66K corresponding to the photosensitive member 40K may be pressed toward the photosensitive member 40K, whereas the remaining transfer rollers 66Y, 66M and 66C are spaced apart from the photosensitive members 40Y, 40M, and 40C.

When the transfer device 60 transfers the image to the printing medium S, the developer on the transfer belt 61 may not wholly be transferred to the printing medium S, but a part thereof remains on the transfer belt 61. A cleaning device 90 is used to remove the remaining waste developer from the transfer belt 61.

The cleaning device 90 may include a cleaning frame 91, a cleaning blade 92, and a waste developer feed member 94.

A waste developer storage 95 is defined in the interior of the cleaning frame 91, and the cleaning blade 92 may be mounted at one side of the waste developer storage 95. The cleaning blade 92 comes into contact with the outer surface of the transfer belt 61 at a location where the transfer belt 61 is supported by the supporting roller 63. One end of the cleaning blade 92 may apply friction to the transfer belt 61, scraping the developer remaining on the surface of the transfer belt 61.

The waste developer removed from the transfer belt 61 by the cleaning blade 92 is stored in the waste developer storage 95. The waste developer storage 95 may be provided with the waste developer feed member 94, so that the waste developer feed member 94 feeds the waste developer stored in the waste developer storage 95 to a waste developer container (not illustrated).

The printing medium S, having passed through the transfer device 60, may enter the fusing device 70. The fusing device 70 may include a heating roller 72 and a press roller 74. When the printing medium S onto which the image has been transferred passes between the heating roller 72 and the press roller 74, the image is fixed to the printing medium S under the influence of heat and pressure.

The printing medium S, having passed through the fusing device 70, may be guided to the printing medium discharge device 80 and discharged out of the body 10 by discharge rollers 82.

Figure 2:
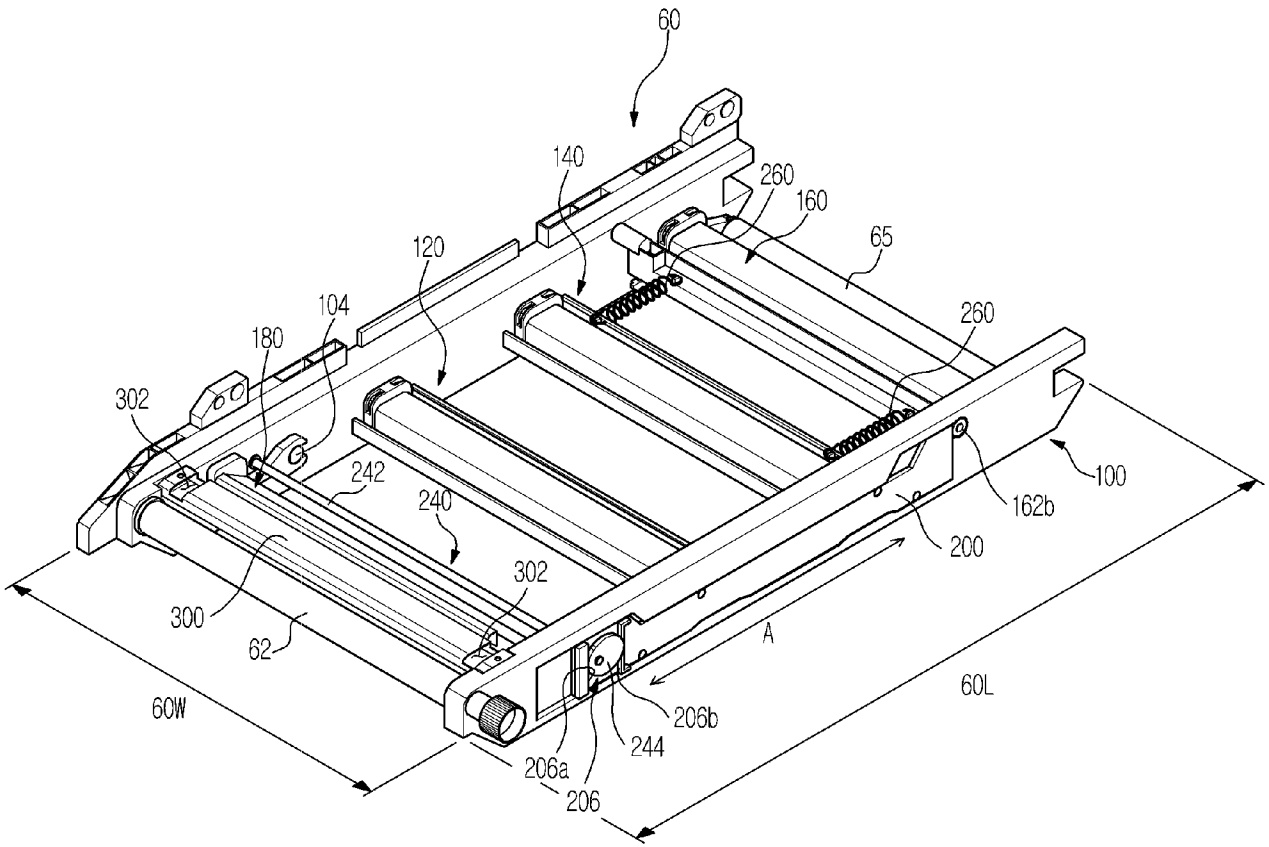
FIG. 2 is a perspective view illustrating a partial configuration of a transfer device according to an exemplary embodiment of the present general inventive concept.
Figure 3:
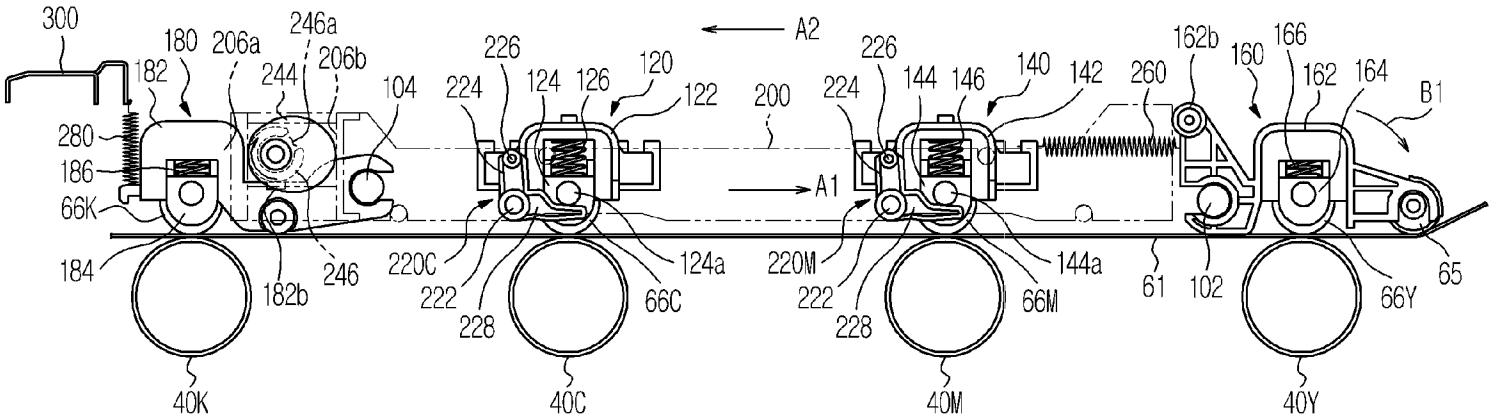
FIG. 3 is a front view illustrating a partial configuration of the transfer device of FIG. 2.

FIG. 2 is a perspective view illustrating a partial configuration of a transfer device according to an exemplary embodiment of the present general inventive concept, and FIG. 3 is a front view illustrating a partial configuration of the transfer device of FIG. 2.

As illustrated in FIGS. 2 and 3, the transfer device 60 may include a supporting frame 100, first to fourth transfer units 120, 140, 160, and 180, sliders 200, levers 220C and 220M, a drive unit 240, and a supporting unit 300.

The supporting frame 100 supports a variety of constituent elements of the transfer device 60. The driving roller 62 and the supporting roller 63 are rotatably mounted to the supporting frame 100.

The first to fourth transfer units 120, 140, 160, and 180 may be coupled to the supporting frame 100, to correspond to the respective photosensitive members 40Y, 40M, 40C, and 40K. The first to fourth transfer units 120, 140, 160, and 180 are arranged in a first direction A. Specifically, the first and second transfer units 120 and 140 are arranged such that ends thereof face inner surfaces of the sliders 200. And, the third transfer unit 160 is arranged at one end of the respective sliders 200 in the first direction A, and the fourth transfer unit 180 is arranged at an opposite side of the third transfer unit 160 in the first direction A.

The first transfer unit 120 may include a first roller frame 122 secured to the supporting frame 100, the first transfer roller 66C mounted to the first roller frame 122, a holder 124 connected to an end of a roller shaft of the first transfer roller 66C, and an elastic member 126 to press the first transfer roller 66C toward the first photosensitive member 40C. The elastic member 126 may be a compressible coil spring.

The holder 124 may rotatably support the end of the roller shaft and may be movably connected to an end of the first roller frame 122. The elastic member 126 may be provided between the holder 124 and the first roller frame 122. One end of the elastic member 126 is supported by an upper surface of the holder 124, and the other end of the elastic member 126 is supported by an inner top surface of the first roller frame 122.

With the above-described configuration, the first transfer roller 66C is elastically supported by the first roller frame 122. Then, if external force is applied to the holder 124, the first transfer roller 66C may be moved away from the first photosensitive member 40C. As soon as the external force acting on the holder 124 is released, the first transfer roller 66C may be moved toward the first photosensitive member 40C by elastic force of the elastic member 126, thereby elastically pressing the first photosensitive member 40C with the transfer belt 61 interposed there between.

The second transfer unit 140 may have approximately the same configuration as the first transfer unit 120. Specifically, the second transfer unit 140 may include a second roller frame 142 secured to the supporting frame 100, the second transfer roller 66M mounted to the second roller frame 142, a holder 144 connected to an end of the second transfer roller 66M, and an elastic member 146 to press the second transfer roller 66M toward the second photosensitive member 40M.

Similar to the first transfer roller 66C, the second transfer roller 66M may be elastically supported by the second roller frame 142. Then, if external force is applied to the holder 144, the second transfer roller 66M is moved away from the second photosensitive member 40M. As soon as the external force acting on the holder 144 is released, the second transfer roller 66M may be moved toward the second photosensitive member 40M by elastic force of the elastic member 146, thereby elastically pressing the second photosensitive member 40M with the transfer belt 61 interposed therebetween.

The third transfer unit 160 may include a third roller frame 162 rotatably coupled to the supporting frame 100, the third transfer roller 66Y mounted to the third roller frame 162, a holder 164 connected to an end of the third transfer roller 66Y, and an elastic member 166 to press the third transfer roller 66Y toward the third photosensitive member 40Y.

The third roller frame 162 is pivotally rotatably coupled to a hinge shaft 102 of the supporting frame 100. First elastic units 260 are provided to bias the third roller frame 162 in a direction of spacing the third transfer roller 66Y from the third photosensitive member 40Y.

The first elastic units 260 may be tensile coil springs. One end of each first elastic unit 260 may be supported on the third roller frame 162, and the other end of the first elastic unit 260 may be supported on the second roller frame 142.

The third roller frame 162 may be provided at the top thereof with interference arms 162*b* each facing one end of the corresponding slider 200. If the sliders 200 that will be described hereinafter are linearly moved to thereby interfere with the interference arms 162*b* of the third roller frame 162, the third roller frame 162 may pivotally rotate about the hinge shaft 102, causing the third transfer roller 66Y to be moved toward the third photosensitive member 40Y. Thereby, the third transfer roller 66Y may elastically press the third photosensitive member 40Y with the transfer belt 61 interposed therebetween.

In the meantime, the tension roller 65 may be rotatably mounted to the third roller frame 162. As the third roller frame 162 is rotated about the hinge shaft 102, the tension roller 65 may press the inner surface of the transfer belt 61 or release force acting on the inner surface of the transfer belt 61.

Each of the sliders 200 may linearly move while mounted to a corresponding side surface of the supporting frame 100. The slider 200 linearly reciprocally moves in the first direction A1 via operation of the drive unit 240, thereby enabling movement of the first transfer roller 66C, the second transfer roller 66M and the third roller frame 162.

The slider 200 may extend in the first direction A1, one end thereof facing the third roller frame 162.

The lever 220C may be provided between the slider 200 and the first transfer roller 66C, and the lever 220M is provided between the slider 200 and the second transfer roller 66M. The levers 220C and 220M may transmit movement of the slider 200 to the first transfer roller 66C and second transfer roller 66M, allowing the first transfer roller 66C and second transfer roller 66M to be moved away from the transfer belt 61.

The levers 220C and 220M may be pivotally rotatably coupled to the supporting frame 100 via lever rotating shafts 222. Each of the levers 220C and 220M have a first lever arm 224 and a second lever arm 228.

The first lever arm 224 is provided at an end thereof with a coupling arm 226 extending to the slider 200. The coupling arm 226 is inserted into a coupling recess (not illustrated) indented in the slider 200.

The holder 124 or 144 may have a holder arm 124*a* or 144*a* protruding to the slider 200. The second lever arm 228 extends below the holder arm 124*a* or 144*a*.

A cam accommodation section 206 is defined in the other end of the slider 200, to receive a first cam 244 that will be described hereinafter. The slider 200 may include sidewalls 206*a* and 206*b* provided at opposite sides of the cam accommodation section 206. The sidewalls 206*a* and 206*b* are pressed by the first cam 244 based on a rotating position of the first cam 244.

The fourth transfer unit 180 may include a fourth roller frame 182 rotatably coupled to the supporting frame 100, the fourth transfer roller 66K mounted to the fourth roller frame 182, a holder 184 connected to an end of the fourth transfer roller 66K, and an elastic member 186 to press the fourth transfer roller 66K toward the fourth photosensitive member 40K.

The fourth roller frame 182 is coupled to a hinge shaft 104 of the supporting frame 100. Second elastic units 280 may be provided to bias the fourth roller frame 182 in a direction of spacing the fourth transfer roller 66K from the fourth photosensitive member 40K. The second elastic units 280 may be tensile coil springs. One end of each second elastic unit 280 is supported on the fourth roller frame 182, and the other end of the second elastic unit 280 is supported by the supporting unit 300.

The fourth roller frame 182 may be provided with interference protuberances 182*b*. If each interference protuberance 182*b* is pressed by a second cam 246 that will be described hereinafter, the fourth roller frame 182 may rotate, causing the fourth transfer roller 66K to be moved toward the fourth photosensitive member 40K.

The drive unit 240 may include a rotating shaft 242 rotatably mounted to the supporting frame 100, and the first and second cams 244 and 246 connected to ends of the rotating shaft 242. The rotating shaft 242 and the first and second cams 244 and 246 are rotated upon receiving power transmitted from a drive source (not illustrated). The first and second cams 244 and 246 may take the form of a single integrated member.

The first cam 244 may press one of the sidewalls 206*a* and 206*b* of the slider 200 based on a rotating position thereof, so as to allow the slider 200 to be linearly moved in the first direction A.

The second cam 246 may press the interference protuberance 182*b* of the fourth roller frame 182, initiating rotation of the fourth transfer unit 180. The second cam 246 has a receiving recess 246*a*, such that the interference protuberance 182*b* may be received in the receiving recess 246*a* based on a rotating position of the second cam 246. Once the interference protuberance 182*b* is seated in the receiving recess 246*a*, the second cam 246 may not apply press force to the interference protuberance 182*b* of the fourth roller frame 182, allowing the fourth roller frame 182 to be returned to an original position thereof by elastic force of the second elastic unit 280.

When the image forming apparatus 1 performs a color printing mode, the first cam 244 may press the sidewall 206*b* of the slider 200, causing the slider 200 to be linearly moved in a direction A1. With the linear movement of the slider 200, the levers 220C and 220M, which are coupled to the slider 200, may be rotated clockwise and thus, the first transfer roller 66C and second transfer roller 66M are moved toward the first photosensitive member 40C and second photosensitive member 40M by elastic force of the elastic members 126 and 146. In this way, the first transfer roller 66C and second transfer roller 66M press the first photosensitive member 40C and second photosensitive member 40M through the transfer belt 61.

As the slider 200 is moved in the direction A1, further, the slider 200 pushes the third roller frame 162, causing clockwise rotation of the third roller frame 162, as illustrated in B1 of FIG. 3. As a result, the third transfer roller 66Y is moved toward the third photosensitive member 40Y, thereby pressing the third photosensitive member 40Y.

The second cam 246 may press the interference protuberance 182*b* of the fourth roller frame 182 in the color printing mode. As a result, the fourth transfer roller 66K is maintained to continuously press the fourth photosensitive member 40K.

As described above, during the color printing mode of the image forming apparatus 1, the first to fourth transfer rollers 66C, 66M, 66Y, and 66K are operated to press the first to fourth photosensitive members 40C, 40M, 40Y, and 40K. Accordingly, the images formed on the first to fourth photosensitive members 40C, 40M, 40Y, and 40K are transferred to and overlap one another on the transfer belt 61, enabling a desired color of an image to be formed on the transfer belt 61.

To acquire a high quality image, it may be necessary to appropriately adjust an image density or to accurately align images to be overlapped. To this end, the image forming apparatus may detect a color registration error or image density error on the transfer belt using sensors, and controls image forming devices based on the results.

Additionally, the first cam 244 may move away from contact with one of the sidewalls 206*a* and 206*b* of the slider 200 based on a rotating position thereof, so as to allow the slider to be linearly moved in a second direction A2, as illustrated in FIG. 3.

As the slider is moved in the direction A2, the slider 200 pulls the third roller frame 162, causing the third roller frame 162 to travel in a counter-clockwise rotation of the third roller frame 162, thus minimizing contact between the third photosensitive member 40Y with the third transfer roller 66Y.

Figure 4:
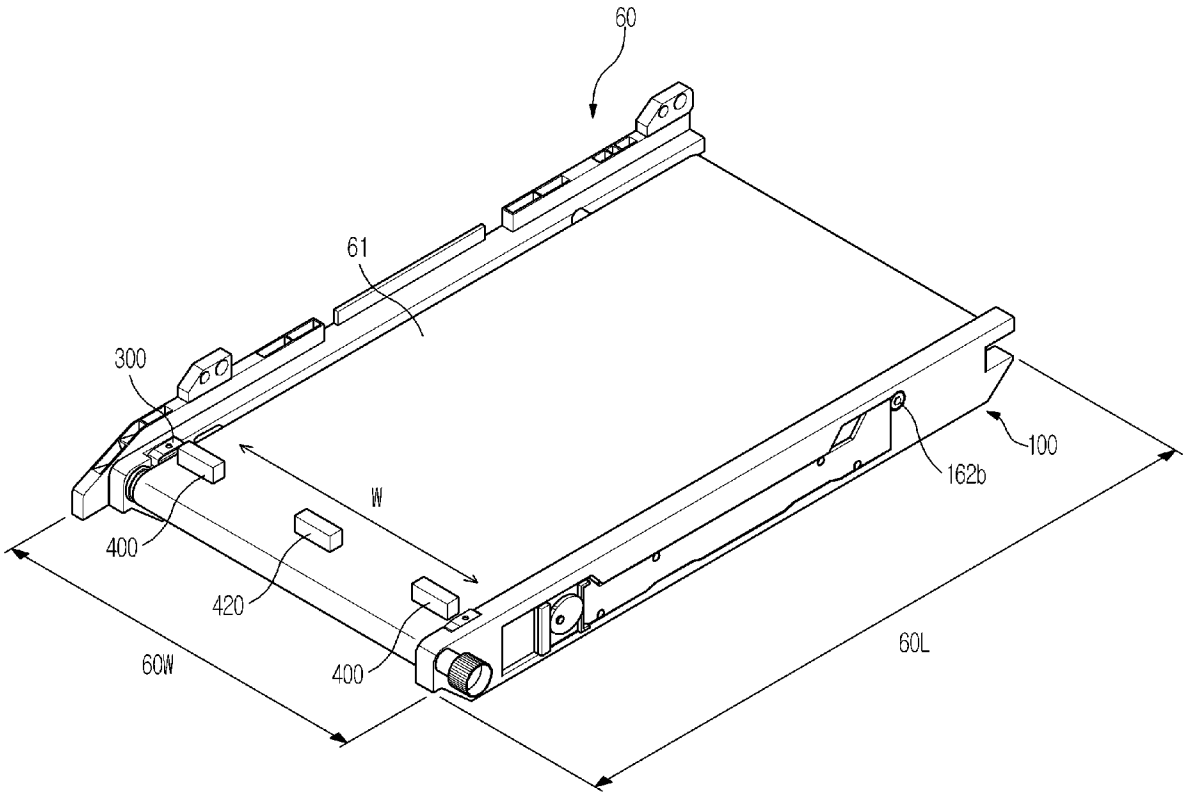
FIG. 4 is a perspective view illustrating the transfer device and sensors included in the image forming apparatus according to an exemplary embodiment of the present general inventive concept.
Figure 5:
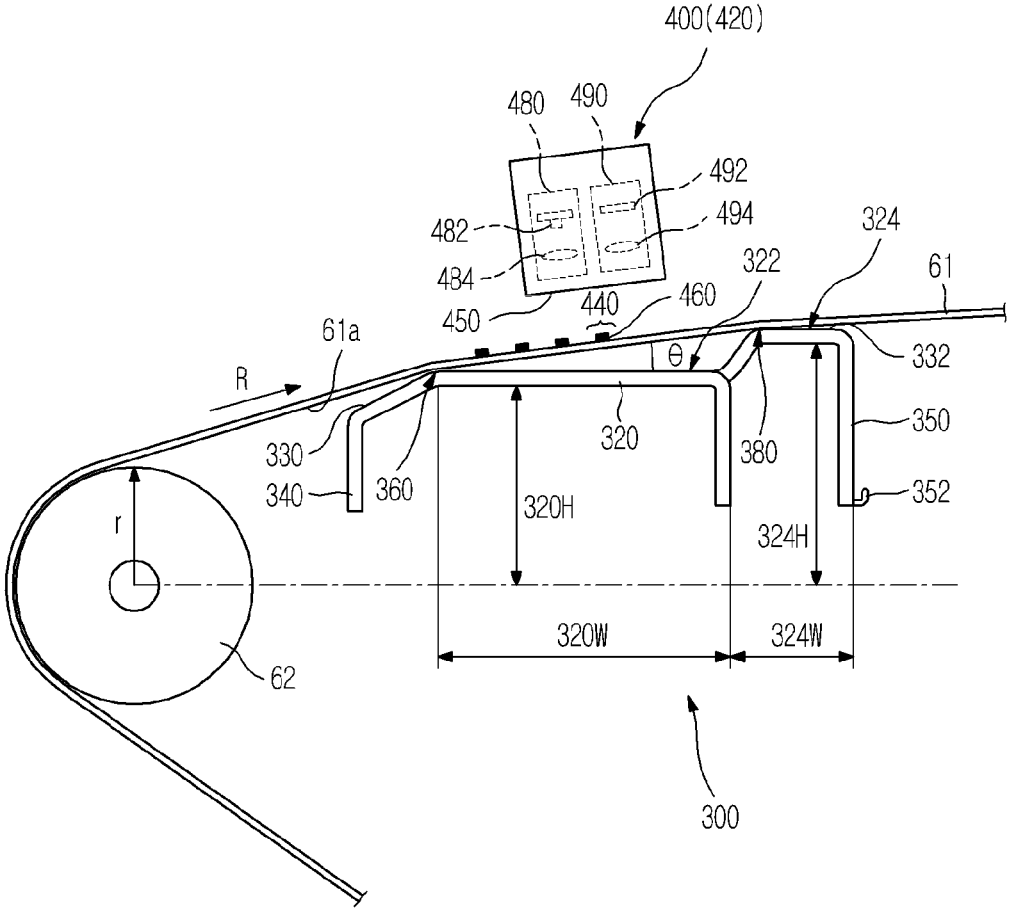
FIG. 5 is an enlarged view of a partial configuration of the transfer device according to an exemplary embodiment of the present general inventive concept.

FIG. 4 is a perspective view illustrating the transfer device and sensors included in the image forming apparatus according to an exemplary embodiment of the present general inventive concept, and FIG. 5 is an enlarged view of a partial configuration of the transfer device according to an exemplary embodiment of the present general inventive concept.

As illustrated in FIG. 4, the image forming apparatus 1 may include one or more sensors 400 and 420 to sense marks 460 formed on the transfer belt 61, wherein the one or more sensors 400 and 420 may include a bottom surface 450 facing the transfer belt 61. Although FIG. 4 illustrates an exemplary configuration in which the color registration sensors 400 are arranged on the transfer belt 61 at opposite sides of a width direction W of the transfer belt 61 and the image density sensor 420 is arranged at the center of the transfer belt 61, the type, number and position of the sensors may be changed.

As illustrated in FIG. 5, the color registration sensors 400 define a sensing region 440 on the transfer belt 61 and sense the marks 460 located on the sensing region 440 to detect a registration error.

Each of the color registration sensors 400 may include a light emitting part 480 to irradiate a beam to the mark 460 and a light receiving part 490 to receive the beam reflected from the mark 460 and/or the transfer belt 61.

The light emitting part 480 may include a light source 482 to generate and emit a beam, and a condensing lens 484 to concentrate the beam emitted from the light source 482 to the mark 460. The light source may be a light emitting diode. The light receiving part 490 may include a photo-detector 492 to receive a beam and perform photoelectric transformation, and a condensing lens 494 to concentrate the beam reflected from the mark 460 to the photo-detector 492. The light receiving part 490 may transmit a detected current signal to a control unit (not illustrated) of the image forming apparatus 1. The control unit extracts information for color registration correction from the detected signal, and may control image forming devices (e.g., the light scanning device) based on the results.

Similar to the color registration sensors 400, the image density sensor 420 may be a photo sensor. The image density sensor 420 senses an image density mark formed on the transfer belt 61 to detect an image density error.

If the transfer belt 61 undergoes wrinkles or oscillation at and near the sensing region 400 during detection of the color registration error or image density error that is carried out to enhance image quality, reliability of information measured by the sensors 400 and 420 may be deteriorated.

As illustrated in FIGS. 2, 3, and 5, the image forming apparatus 1 may include the supporting unit 300 provided to support the transfer belt 61 at a position corresponding to the sensors 400 and 420. The supporting unit 300 may press the inner surface of the transfer belt 61 by a predetermined pressure to apply a tensile force to the transfer belt 61, thereby preventing wrinkles and oscillation of the transfer belt 61 at and near the sensing region 440.

The sensors 400 and 420 and the supporting unit 300 may be arranged close to the driving roller 62 at a position downstream of the driving roller 62 in a rotating direction R of the transfer belt 61. Since the transfer belt 61 has low droop or oscillation at an end region thereof close to the driving roller 62, more accurate sensing results may be accomplished when the sensors 400 and 420 and the supporting unit 300 are arranged in the end region to enable a more accurate sensing operation.

The supporting unit 300 may have a plate shape and both ends of the supporting unit 300 may be coupled to both sides of the supporting frame 100. Recesses 302 may be indented in both the ends of the supporting unit 300. The transfer belt 61 is provided at the inner surface thereof with a guide rail (not illustrated) so that the guide rail is accommodated in the recesses 302 to prevent deviation or separation of the transfer belt 61.

The supporting unit 300 may include a supporting plate 320 extending in the rotating direction R of the transfer belt 61. The supporting plate 320 has a supporting surface 322 facing the inner surface 61*a* of the transfer belt 61. The vertical distance between the supporting surface 322 and the center of the driving roller 62 constitutes distance 320H, which varies according to a distance from the driving rollers 62. Also, both ends of the supporting unit 300 may be formed on both sides of the supporting plate 320.

The supporting unit 300 may include reinforcement plates 340 and 350 extending orthogonally from both ends of the supporting plate 320 in the rotating direction R of the transfer belt 61. When both the ends of the supporting plate 320 are bent downward, it may be possible to prevent damage to the transfer belt 61. Also, the reinforcement plates 340 and 350 may increase the strength of the supporting unit 300. A hook 352 may be formed at the reinforcement plate 350 adjacent to the fourth transfer unit 180. The hook 352 is coupled with an end of the second elastic unit 280 thus supporting the fourth roller frame 182.

The supporting unit 300 may include a first supporting portion 360 and a second supporting portion 380, which press and support the transfer belt 61 at different two positions in the rotating direction R of the transfer belt 61. The sensors 400 and 420 to sense the marks 460 formed on the transfer belt 61 may be arranged between the first supporting part 360 and the second supporting part 380.

For example, when the supporting unit 300 supports a single local region of the transfer belt 61, wrinkles and oscillation of the transfer belt 61 may be divided into halves about a supporting position of the supporting unit 300.

However, in the case where the supporting unit 300 supports the transfer belt 61 on at least two positions with the sensing region 440 interposed there between as illustrated in FIG. 5, a tensile force effectively acts on at and near the sensing region 440. This may prevent deterioration in the reliability of a sensing operation due to wrinkles and oscillation of the transfer belt 61.

The supporting surface 322 of the supporting unit 300 has a raised portion 324. The raised portion 324 protrudes farther toward the transfer belt 61 than the remaining portion of the supporting surface 322. The first supporting portion 360 of the supporting unit 300 may be provided at the remaining portion of the supporting surface 322, whereas the second supporting portion 380 may be provided at the raised portion 324.

The first supporting portion 360 is located between the driving roller 62 and the second supporting portion 380 in the rotating direction R of the transfer belt 61. If the first supporting portion 360 arranged close to the driving roller 62 strongly presses the inner surface 61*a* of the transfer belt 61, a contact area between the driving roller 62 and the transfer belt 61 may decrease, causing slippage of the transfer belt 61 on the driving roller 62. Therefore, the second supporting portion 380 located farther from the driving roller 62 than the first supporting portion 360 may be configured to more strongly press the transfer belt 61 than the first supporting portion 360.

The supporting surface 322 may include a non-contact portion 328 between the first supporting portion 360 and the second supporting portion 380 to be spaced apart from the inner surface 61*a* of the transfer belt 61. This configuration may prevent the transfer belt 61 from experiencing friction with the supporting unit 300 between the first supporting portion 360 and the second supporting portion 380, resulting in improved reliability of a sensing operation.

The transfer belt 61 may obliquely extend between the first supporting portion 360 and the second supporting portion 380 to have an inclination with respect to the supporting surface 322. The sensors 400 and 420 may have the same inclination as the transfer belt 61 and thus, may be arranged parallel to the transfer belt 61.

An inclination angle θ of the transfer belt 61 created as the first supporting portion 360 and the second supporting portion 380 press the inner surface 61*a* of the transfer belt 61 may be 5 degrees or more. This angle range is suitable to effectively prevent wrinkles and oscillation of the transfer belt 61 between the first supporting portion 360 and the second supporting portion 380.

If the sensors 400 and 420 are not parallel to the transfer belt 61, the inclination angle θ of the transfer belt 61 may be 10 degrees or less. In addition, when the sensors 400 and 420 have an inclination with respect to the transfer belt 61, the inclination angle of the sensors 400 and 420 may be 10 degrees or less. This angle range is suitable to maintain sensing accuracy of the sensors 400 and 420.

The inclination angle θ of the transfer belt 61 may be 30 degrees or less. If the angle θ exceeds 30 degrees, serious slippage between the driving roller 62 and the transfer belt 61 may occur and also, arrangement of the sensors 400 and 420 and the supporting unit 300 may be difficult due to structural constraints.

In the meantime, the supporting surface 322 of the supporting unit 300 may include a first guide surface 330 upstream of the first supporting portion 360 in the rotating direction R of the transfer belt 61 and a second guide surface 332 downstream of the second supporting portion 380 in the rotating direction R of the transfer belt 61. The first guide surface 330 and the second guide surface 332 may guide rotation of the transfer belt 61 near the first supporting portion 360 and the second supporting portion 380, thus improving traveling stability of the transfer belt 61. The vertical distance between the second guide surface 332 and the center of the driving roller 62 constitutes distance 324H.

Further, the width of the supporting plate 320 is illustrated in FIG. 5 as element 320W and the width of the second guide surface 332 is illustrated as element 324W.

Although FIG. 5 illustrates an exemplary configuration in which the first and second supporting portions are formed via a stepped configuration of the supporting surface, in an alternative exemplary embodiment, the first and second supporting portions may be formed via a plurality of protrusions formed on the supporting surface.

In addition, although FIG. 5 illustrates an exemplary configuration in which both the first and second supporting portions press and support the inner surface of the transfer belt, in an alternative exemplary embodiment, any one of the two supporting portions may be arranged to press and support the outer surface of the transfer belt.

Figure 8:
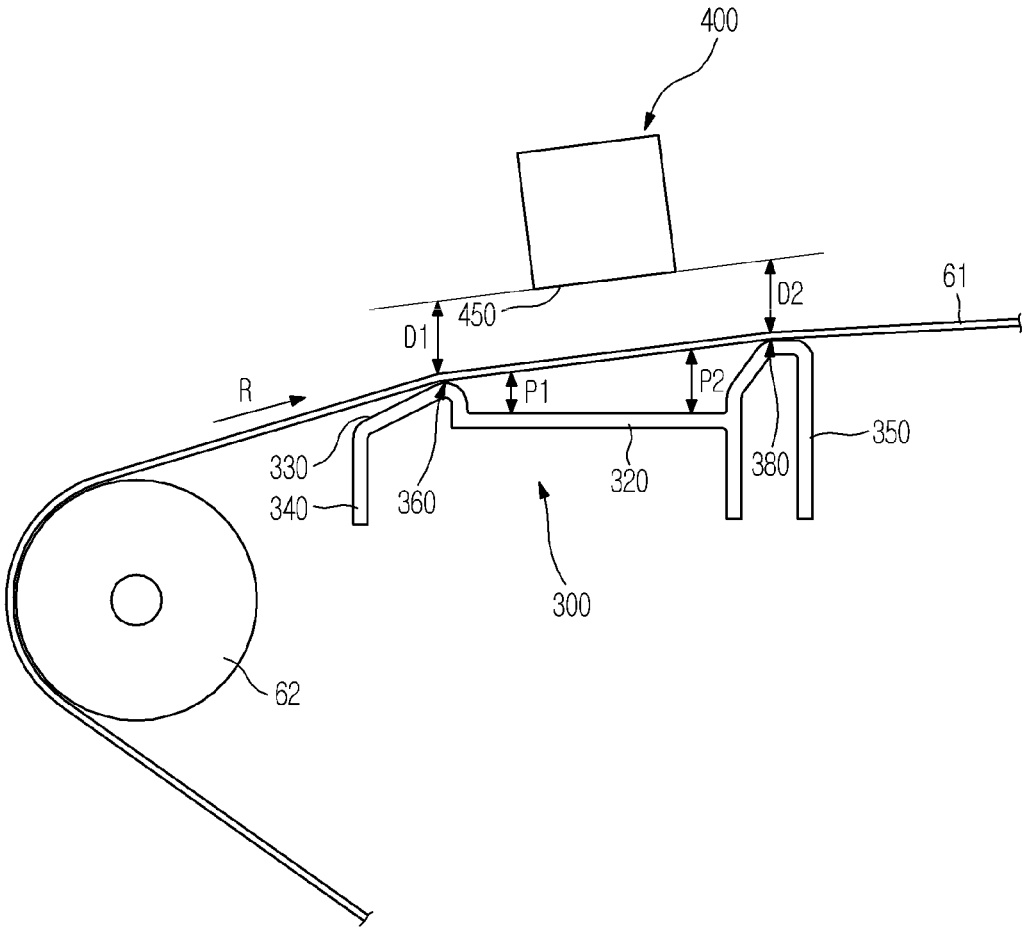
FIG. 8 is an enlarged view of a partial configuration of the transfer device according to an alternative exemplary embodiment of the present general inventive concept.

FIG. 8 illustrates an alternative shape of the supporting unit 300. The supporting unit 300 in FIG. 8 includes a sunken supporting plate 320, which is further away from the sensor 400 than the first supporting position 360 and the second supporting position 380. Also illustrated are two distances P1 and P2 measured from the first and second supporting portions 360/380 to the transfer belt 61. Further illustrated are two distances D1 and D2 measured from the first and second supporting portions 360/380 to a plane formed along the bottom surface 450 of the sensor 400.

Figure 6A:
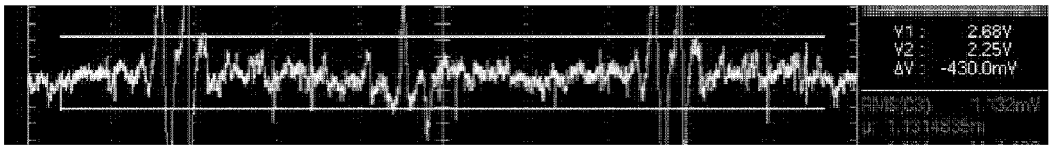
FIGS. 6A, 6B, 7A, and 7B are graphs illustrating oscillation measurement results of a circulating transfer belt in experiments in which a surface of the transfer belt is sensed using sensors.
Figure 6B:
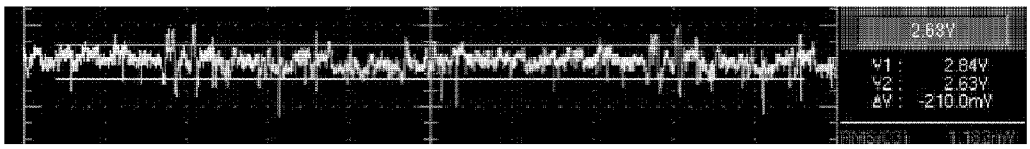
Figure 7A:
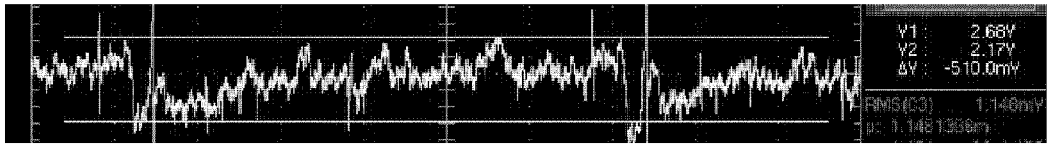
Figure 7B:
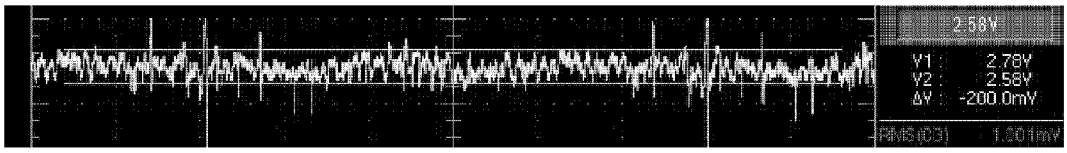

FIGS. 6A, 6B, 7A, and 7B are graphs illustrating oscillation measurement results of the circulating transfer belt in experiments in which the surface of the transfer belt are sensed using the sensors. FIGS. 6A and 6B illustrate results of a first experiment and FIGS. 7A and 7B are results of a second experiment. FIGS. 6A and 7A illustrate results measured when the supporting unit supports the transfer belt at a single position differently from the above described embodiment (hereinafter, referred to as a "comparative embodiment"), and FIGS. 6B and 7B illustrate results measured when the supporting unit supports the transfer belt at two positions as illustrated in FIG. 5.

In FIGS. 6A, 6B, 7A, and 7B, the abscissa represents time and the ordinate represents a voltage output from the sensor. Values "V1" and "V2" are maximum and minimum sensor output values due to oscillation of the transfer belt. The sensor periodically detects peak values larger or smaller than the values "V1" and "V2". These peak values may be caused by structural factors, such as scratches on the transfer belt, and are excluded from consideration.

In the first experiment related to the comparative embodiment, the value "V1" is 2.68V and the value "V2" was 2.25V, and a difference ΔV between the values "V1" and "V2" is 430 mV. In the second experiment related to the comparative embodiment, the value "V1" is 2.68V and the value "V2" is 2.17V, and a difference ΔV between the values "V1" and "V2" is 510 mV.

On the other hand, in the first experiment related to the exemplary embodiment of the present general inventive concept, the value "V1" is 2.84V and the value "V2" was 2.63V, and a difference ΔV between the values "V1" and "V2" is 210 mV. In the second experiment related to the comparative embodiment, the value "V1" is 2.78V and the value "V2" is 2.58V, and a difference ΔV between the values "V1" and "V2" is 200 mV.

As will be appreciated from the experimental results of FIGS. 6A, 6B, 7A, and 7B, the transfer belt undergoes low oscillation when being supported at two positions thereof.

As apparent from the above description, with the above described configuration according to the exemplary embodiment of the present general inventive concept, it may be possible to effectively prevent wrinkles and oscillation of a transfer belt at or near a sensing region of a sensor. This may enhance reliability of a sensing operation and consequently, may improve image quality.

Although the exemplary embodiment of the present general inventive concept has been illustrated and described, it would be appreciated by those skilled in the art that changes may be made in these exemplary embodiments without departing from the principles and spirit of the present general inventive concept, the scope of which is defined in the claims and their equivalents.

What is claimed is:

1. An image forming apparatus, comprising:

at least one photosensitive member;

a plurality of developing units to supply developer to the at least one photosensitive member so as to form a visible image;

a transfer belt to transfer the visible image formed on the at least one photosensitive member to a printing medium, an inner surface of the transfer belt being rotatably supported by at least two rollers;

at least one sensor to sense a mark formed on the transfer belt; and a supporting unit to support the transfer belt at a position corresponding to the at least one sensor so as to apply a tensile force to the transfer belt, wherein the supporting unit includes a first supporting portion and a second supporting portion arranged to support the transfer belt at a first supporting position and a second supporting position in a rotating direction of the transfer belt such that the first supporting position is upstream from a position on the transfer belt corresponding to the at least one sensor and the second supporting position is downstream from the position on the transfer belt corresponding to the at least one sensor.

2. The image forming apparatus according to claim 1, wherein the at least one sensor is arranged to sense the mark of the transfer belt between the first supporting portion and the second supporting portion.

3. The image forming apparatus according to claim 1, wherein:

the supporting unit includes a supporting surface facing the inner surface of the transfer belt and extending in the rotating direction of the transfer belt; and the supporting surface includes at least one raised portion protruding farther toward the transfer belt than the remaining portion of the supporting surface.

4. The image forming apparatus according to claim 3, wherein a part of the supporting surface is arranged so as not to come into contact with the transfer belt.

5. The image forming apparatus according to claim 3, wherein the transfer belt obliquely extends with respect to the supporting surface between the first supporting portion and the second supporting portion of the supporting unit.

6. The image forming apparatus according to claim 5, wherein an inclination angle of the transfer belt with respect to the supporting surface of the supporting unit is about 30 degrees or less.

7. The image forming apparatus according to claim 3, wherein the supporting surface includes a first guide surface upstream of the first supporting portion in the rotating direction of the transfer belt and a second guide surface downstream of the second supporting portion in the rotating direction of the transfer belt.

8. The image forming apparatus according to claim 1, wherein:

the at least two rollers include a driving roller to provide the transfer belt with drive force; and the supporting unit is arranged adjacent to the driving roller at a position downstream of the driving roller in the rotating direction of the transfer belt.

9. The image forming apparatus according to claim 2, wherein:

the at least one sensor is inclined with respect to the transfer belt between the first supporting portion and the second supporting portion; and an inclination angle of the at least one sensor with respect to the transfer belt is about 10 degrees or less.

10. An image forming apparatus, comprising:

a plurality of developing units, each of the plurality of developing units including a photosensitive member respectively and being configured to supply developer to the corresponding photosensitive member so as to form visible images;

a transfer belt arranged to come into contact with the plurality of photosensitive members to allow the visible images formed on the plurality of photosensitive members to be transferred to and overlap one another on the transfer belt, an inner surface of the transfer belt being rotatably supported by at least two rollers;

at least one sensor to sense a mark formed on the transfer belt; and a supporting unit to support the transfer belt at a position corresponding to the at least one sensor so as to apply a tensile force to the transfer belt, wherein the supporting unit includes a first supporting portion arranged to press and support the inner surface of the transfer belt, and a second supporting portion spaced apart from the first supporting portion in a rotating direction of the transfer belt and protruding farther toward the transfer belt than the first supporting portion to press and support the inner surface of the transfer belt simultaneously with the first supporting portion.

11. The image forming apparatus according to claim 10, wherein the at least one sensor is arranged to sense the mark of the transfer belt between the first supporting portion and the second supporting portion.

12. The image forming apparatus according to claim 10, wherein:

the at least two rollers include a driving roller to provide the transfer belt with drive force; and the supporting unit is arranged adjacent to the driving roller at a position downstream of the driving roller in the rotating direction of the transfer belt.

13. The image forming apparatus according to claim 12, wherein the first supporting portion is arranged between the driving roller and the second supporting portion in the rotating direction of the transfer belt.

14. The image forming apparatus according to claim 11, wherein:

the at least one sensor is inclined with respect to the transfer belt between the first supporting portion and the second supporting portion; and an inclination angle of the at least one sensor with respect to the transfer belt is about 10 degrees or less.

15. A transfer device to be mounted in an image forming apparatus including at least one sensor, the transfer device comprising:

at least two rollers;

a transfer belt including a sensing region to be sensed by the at least one sensor and rotatably supported by the at least two rollers; and a supporting plate arranged to support an inner surface of the transfer belt so as to apply a tensile force to the transfer belt, wherein the supporting plate includes a first supporting portion arranged to come into contact with the transfer belt at a position upstream of the sensing region in a rotating direction of the transfer belt, a second supporting portion arranged to come into contact with the transfer belt at a position downstream of the sensing region in the rotating direction of the transfer belt, and a non-contact portion spaced apart from the inner surface of the transfer belt between the first supporting portion and the second supporting portion, and wherein the second supporting portion protrudes farther toward the transfer belt than the first supporting portion.

16. The transfer device according to claim 15, wherein the supporting plate is arranged close to one of the at least two rollers.

17. The transfer device according to claim 16, wherein:

the supporting plate is arranged downstream of one of the at least two rollers in the rotating direction of the transfer belt.

18. The transfer device according to claim 15, wherein:

the supporting plate further includes a supporting surface facing the inner surface of the transfer belt and extending in the rotating direction of the transfer belt; and the supporting surface includes a stepped portion.

* * * * *